United States Patent [19]

Illakowicz

[11] Patent Number: 4,838,170

[45] Date of Patent: Jun. 13, 1989

[54] DRIVE WHEEL UNIT

[75] Inventor: Jan Illakowicz, New Orleans, La.

[73] Assignee: McDermott International, Inc., New Orleans, La.

[21] Appl. No.: 258,419

[22] Filed: Oct. 17, 1988

[51] Int. Cl.[4] ..... B61B 13/10

[52] U.S. Cl. ..... 104/138.2

[58] Field of Search ..... 104/138.1, 138.2; 105/73, 164

[56] References Cited

U.S. PATENT DOCUMENTS

| | | | |
|---|---|---|---|
| 774,525 | 11/1904 | Mack | 104/138.2 X |
| 2,604,521 | 7/1952 | Boucher | 104/138.2 X |
| 3,979,941 | 9/1976 | Auxer | 104/138.2 X |
| 4,034,679 | 7/1977 | Gaither et al. | 104/138.1 |

*Primary Examiner*—Robert B. Reeves
*Assistant Examiner*—Gary C. Hoge
*Attorney, Agent, or Firm*—Robert J. Edwards; D. Neil LaHaye

[57] ABSTRACT

A drive wheel unit for moving equipment inside a pipe. A housing is connected to associated equipment by U-joints on either side of the housing. A drive wheel which extends above the top edge of the housing is driven by a drive motor and gear reducer mounted in the housing. A brake connected to the drive motor allows precise positioning of the equipment. A hydraulic cylinder and piston arrangement and wheel attached thereto are provided at each end of the housing and are used to lift the housing into a driving position where the drive wheel is in driving engagement with the top inside surface of the pipe.

7 Claims, 2 Drawing Sheets

DRIVE WHEEL UNIT

BACKGROUND OF THE INVENTION

1. Field of the Invention

The invention relates to welding equipment and in particular to a propulsion unit for driving welding equipment inside pipe sections being welded together to form a pipeline.

2. General Background

In operations such as laying continuous pipeline on land or offshore, a common method of welding the pipe sections together is by flash butt welding. In this type of operation the pipe sections are clamped together end-to-end and heated electrically by electrical contact shoes. As the temperature of each pipe end increases and reaches forging temperature, the pipe ends are forced together to expel molten metal and undesirable oxides and forge the two pipe ends together. The slag or flash, sometimes referred to as upset metal, is then removed by specialized flash removal devices. Another pipe section is then moved into position to be added to the pipeline and the process is repeated. Since equipment such as clamping, welding, flash removal, and measuring devices are normally positioned inside the pipe during these operations, it is necessary to have some means of effectively moving this equipment within the pipe sections to the proper positions for carrying out such operations. Applicant is aware of the following units aimed at driving machinery inside of pipes.

U.S. Pat. No. 3,044,431 entitled "Internal Pipe Clamp" discloses a pivoted link with a pair of traction wheels rotatably mounted at the free end. The link is pivotally attached to the bottom of an upwardly extending arm which is attached at its top to an air operated piston and cylinder. Pressurization of the air cylinder causes movement of the wheels into contact with the pipe while a spring on the arm causes the wheels to move out of contact with the pipe when air pressure is released. The wheels are chain driven by an air motor mounted on the framing ring of the clamp.

U.S. Pat. No. 3,633,813 entitled "Internal Pipe Lineup Clamp" discloses driving wheels rotatably mounted on a frame moved up and down by a piston and cylinder combination to cause the drive wheels to move into and out of contact with the pipe. The wheels are chain driven by an air motor.

U.S. Pat. No. 4,436,974 entitled "Pipe Resistance Butt Welding Apparatus" discloses drive wheels fitted to spring loaded levers and connected through a worm gear and a gimbal gear to a rotation drive.

U.S. Pat. Nos. 2,638,069 entitled "Pipe Aligning Device", 2,594,000 entitled "Electric Line-Up Clamp", and 1,427,231 entitled "Electric Seam Welding Machine" disclose various drive mechanisms.

In welding operations such as that described above, the apparatus inside the pipe may be as much as one hundred (100) feet long and weigh as much as twenty-five (25) tons. This presents the need for a driving unit capable of providing substantial driving wheel contact with the pipe and rotational force to the driving wheel for reliably moving such equipment in the pipe.

SUMMARY OF THE INVENTION

The present invention solves the aforementioned problem in a straightforward manner. What is provided is a drive wheel unit connected to the equipment on either side thereof by specially designed joints allowing for pivoting and vertical motion to insure that the loads between adjacent units are not transferred and that the units are not disturbed by each other during engaging and disengaging and driving of the unit. A half tubular frame is provided with lifting mechanisms and driving mechanisms. The lifting mechanisms use a hydraulic cylinder and piston arrangement to cause upward movement of the drive wheel unit within the pipe. This causes drive wheels extending from the top of the unit to come into contact with the top of the pipe. Electric motors positioned in the drive wheel unit cause rotation of the drive wheels by means of drive chains to cause movement of the drive wheel unit and other equipment attached to it into the pipe. Having the drive wheels contact the top inside surface of the pipe is preferable as this reduces the possibility of drive wheel slippage due to debris which may collect at the bottom of the pipe.

In view of the above, it is an object of the present invention to provide a drive wheel unit capable of disengaging the drive wheels from the pipe.

It is another object of the invention to provide a drive wheel unit equipped with brakes for more precise stopping at a predetermined position.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
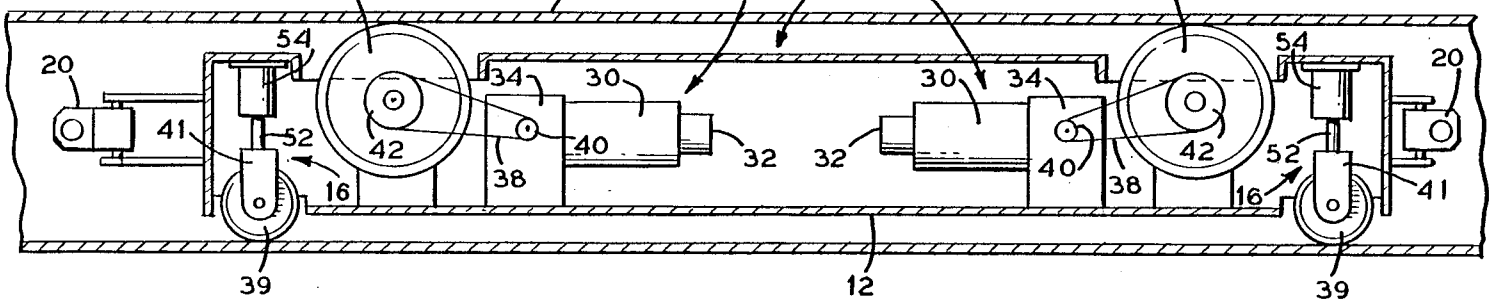
FIG. 1 is a cutaway view of the invention.
Figure 2:
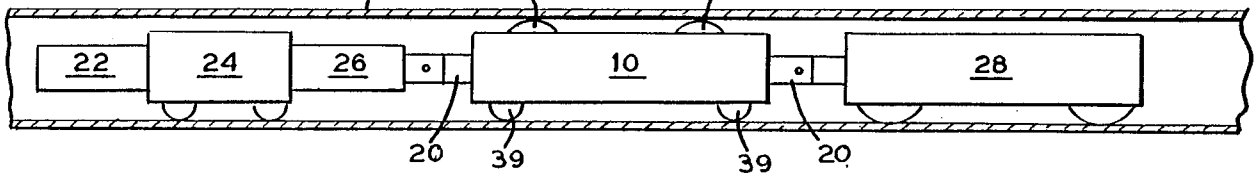
FIG. 2 is a schematic view of the invention attached to adjacent components inside a pipe.

Referring to the drawings, it is seen in FIG. 2 that the invention is generally and schematically indicated by the numeral 10. As best seen in FIG. 1, drive wheel unit 10 is generally comprised of frame or housing 12, drive mechanism 14 mounted in housing 12, and means 16 for lifting housing 12 and causing drive mechanism 14 to engage pipe 18.

As seen in FIG. 1 and 2, housing 12 is connected to related welding equipment inside pipe 18 by U-joints 20. Such related welding equipment normally includes internal flash removal unit 22, weld head 24, hydraulic distribution unit 26, and boom 28. Since the weight of the combined equipment can total as much as twenty-five (25) tons, U-joints 20 are used to insure that the loads from and to the adjacent units are not transferred and that the units are not disturbed by each other.

In the preferred embodiment two drive mechanisms 14 are provided, one mounted at each end of housing 12. Drive motor 30 is preferably a ten (10) horsepower alternating current motor with a mechanical brake 32. Brake 32 is preferably spring loaded with an electromagnetic release. The use of brakes at the end of travel provides more precise control and allows positioning within one-quarter (¼)inch or better of the desired point. Drive motor 30 is directly engaged with gear reducer 34 to provide the desired maximum wheel speed of 37 RPM. Drive wheels 36 preferably have an outer diameter of twenty-four (24) inches and are in driving engagement with gear reducers 34 by means of chain drives 38 and sprockets 40, 42 on gear reducers 34 and drive wheels 36. As seen in FIG. 1, drive wheels 36 are mounted in housing 12 so as to extend beyond the upper edge thereof. Drive wheels 36 are brought into driving engagement with the top of pipe 18 by lifting drive wheel unit 10. The top of pipe 18 provides a better driving surface with reduced chance of slippage or obstruction as it should be relatively free from debris or fluid which may collect on the bottom of pipe 18. Each drive mechanism 14 is comprised of drive motor 30, brake 32, gear reducer 34, drive wheel 36, chain 38, and sprockets 40 and 42.

Figure 3:
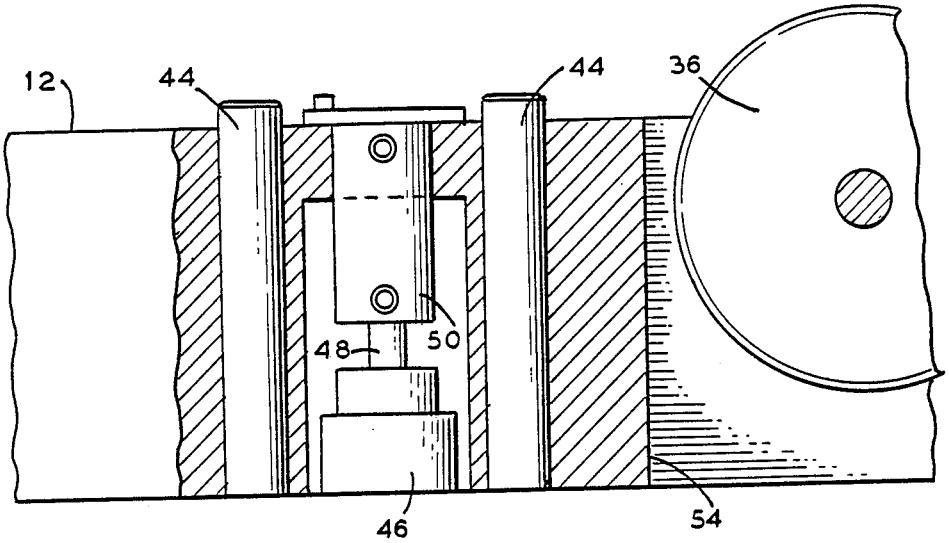
FIG. 3 is a detailed view of a portion of the invention.

Lifting of drive wheel unit 10 into driving position is accomplished by the use of lifting means 16 mounted at each end of housing 12. As best seen in FIG. 1 and 3 lifting means 16 is generally comprised of wheel 39, frame 41, guide pins 44, cylinder 46, and piston 48. Cylinder 46 and piston 48 are connected at one end to housing 12 by means of plate 50 and at a second end to frame 41 by means of frame extension 52. Wheel 39 is rotatably mounted in frame 41. In the preferred embodiment two wheels 39 are provided on each lifting means 16. Cylinder 46 is preferably a hydraulic cylinder in fluid connection with a hydraulic supply source such as hydraulic distribution unit 26. Pressurization of cylinder 46 causes upward movement of piston 48 and consequently lifting of housing 12 into its driving position where drive wheels 36 are in contact with the upper surface of pipe 18. Guide pins 44 are rigidly attached to frame extension 52 and are slidably mounted in guide plates 54 provided on housing 12. Guide pins 44 and guide plates 54 serve to steady frames 42 and wheels 40 when under load.

In operation, cylinders 46 are pressurized by a hydraulic pressure source and caused to lift drive wheel unit 10 from a lowered inoperative position to a lifted driving position where drive wheels 36 are in driving engagement with the inside top surface of pipe 18. Drive motors 30 are then activated. Resulting movement of gear reducers 34 and chain drives 38 cause rotation of drive wheels 36 and movement of drive wheel unit 10 and its associated equipment along the inside of pipe 18. Mechanical brakes 32 are engaged and drive motors 30 stopped upon reaching a desired predetermined location. Pressure is released from cylinders 46 and drive wheel unit 10 is lowered to its inoperative position while work using the related equipment is performed. In the preferred embodiment drive wheel unit 10 weighs 3500 pounds. The preferred operating conditions are a maximum speed of 4ft/sec, maximum acceleration of 1ft/sec. $^2$, a drive wheel rotational speed of 37 RPM, a drive motor rotational speed of 1750 RPM, and a deceleration which does not exceed the maximum acceleration. The total power required to move drive wheel unit 10 and its associated equipment (total weight of 25 tons) equals power to overcome rolling friction (7.5 hp) plus power to accelerate (11.2 hp), which equals 18.7 hp. The two 10 hp motors therefore provide sufficient power. With a calculated minimum traction force of 8516 pounds, the lifting force must be equal to or greater than the minimum traction force plus the total weight of drive wheel unit 10. With a 3500 pound drive wheel unit the minimum lifting force required is 12,016 pounds. In the preferred embodiment two 2½ inch bore cylinders operating at 1500 psi provide 15,000 pounds lifting force. The invention is adaptable for use in different diameter pipes.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A drive wheel unit for moving equipment inside a pipe, comprising:

a. a housing;

b. a drive motor mounted in said housing;

c. a drive wheel in operative engagement with said drive motor and extending above the upper edge of said housing; and d. means mounted in said housing for lifting said housing into a driving position whereby said drive wheel is in driving engagement with the top inside surface of said pipe.

2. The drive wheel unit of claim 1, further comprising a brake connected to said drive motor.

3. The drive wheel unit of claim 1, further comprising a gear reducer connected between said drive motor and said drive wheel.

4. The drive wheel unit of claim 1, wherein said lifting means comprises:

a. a hydraulic cylinder and piston arrangement; and b. a wheel mounted on said hydraulic cylinder and piston arrangement.

5. A drive wheel-unit for moving equipment inside a pipe, comprising:

a. a housing;

b. a drive motor mounted in said housing;

c. a brake connected to said drive motor;

d. a gear reducer connected to said drive motor;

e. a drive wheel in driving engagement with said gear reducer and extending above the upper edge of said housing; and f. means mounted in said housing for lifting said housing into a driving position whereby said drive wheel is in driving engagement with the top inside surface of said pipe.

6. The drive wheel unit of claim 5, wherein said lifting means comprises:

a. a hydraulic cylinder and piston arrangement; and b. a wheel mounted on said hydraulic cylinder and piston arrangement and extending below the lower edge of said housing.

7. The drive wheel unit of claim 5, wherein two of said lifting means are provided, one at each end of said housing.

* * * * *